US009021922B2

(12) United States Patent
Lai

(10) Patent No.: US 9,021,922 B2
(45) Date of Patent: May 5, 2015

(54) INSULATING RATCHET WRENCH

(76) Inventor: Jim Lai, Changhua (TW)

( * ) Notice: Subject to any disclaimer, the term of this patent is extended or adjusted under 35 U.S.C. 154(b) by 0 days.

(21) Appl. No.: 13/818,304

(22) PCT Filed: Apr. 15, 2011

(86) PCT No.: PCT/CN2011/072866

§ 371 (c)(1),
(2), (4) Date: Feb. 22, 2013

(87) PCT Pub. No.: WO2012/139302

PCT Pub. Date: Oct. 18, 2012

(65) Prior Publication Data

US 2014/0053689 A1 Feb. 27, 2014

(51) Int. Cl.
*B25B 13/46* (2006.01)
*B25G 1/12* (2006.01)

(52) U.S. Cl.
CPC ..... *B25B 13/46* (2013.01); *B25G 1/125* (2013.01); *B25B 13/465* (2013.01)

(58) Field of Classification Search
CPC ..... B25B 13/46; B25G 1/12; B25G 1/125
USPC ..... 81/60, 900
See application file for complete search history.

(56) References Cited

U.S. PATENT DOCUMENTS 8,347,759 B2 * 1/2013 Tsai ..... 81/60
2011/0314973 A1 * 12/2011 Tsai ..... 81/60
2012/0174716 A1 * 7/2012 Tsai ..... 81/60

FOREIGN PATENT DOCUMENTS

JP 3165441 U * 1/2011 ..... B25B 13/46

* cited by examiner

*Primary Examiner* — David B Thomas

(57) ABSTRACT

An insulating ratchet wrench includes a wrench body, a ratchet assembly, a main insulator and a knob. The wrench body is covered with the main insulator. The main insulator has a first insulating ring and a second insulating ring. The first insulating ring has a main annular wall and a sub annular wall. The knob has a main annular groove and a sub annular groove. Under this arrangement, the knob is assembled with the main insulator by the main annular groove and the sub annular groove sleeving onto the main annular wall and the sub annular wall respectively so as to form an overlapping structure between the ratchet assembly and the knob. When a user rotates the knob or holds the wrench body near the ratchet assembly, the main insulator avoids an electric shock in a saltatory conduction manner from a charged object via the ratchet assembly.

7 Claims, 6 Drawing Sheets

INSULATING RATCHET WRENCH

BACKGROUND OF THE INVENTION

1. Field of the Invention

The present invention relates to a wrench, and more particularly to an insulating ratchet wrench.

2. Description of Related Art

Numerous hand tools are used in various industries. Although most manufacturing processes are operated by different machines instead, the maintenance and repair operation need to be assisted by the hand tools. Therefore, the hand tools are important in the industries and the improvement of the hand tool is progressed.

The hand tools are typically made by metals. When the machine such as electrical equipment is under repair, a user gets an electrical shock easily because of said metallic hand tools. Therefore, it is dangerous for repairing the electrical equipment by operating said metallic hand tools.

Wrench is the most common hand tool to use. Numerous wrenches have been provided in prior art that are hand held tools for gripping, turning or twisting objects such as nuts or bolts so as to lock or unlock the objects.

In order to solve above problem, a conventional insulating wrench has a plastic handle sleeves onto a handle of the wrench so as to be insulated. However, when the working environment has high voltage and under the humidity condition, the conventional wrench cannot be insulated completely because of a saltatory conduction of the electrical shock. Therefore, the conventional insulating wrench is not safe enough for use.

The present invention has arisen to mitigate and/or obviate the disadvantages of the conventional insulating wrench.

SUMMARY OF THE INVENTION

The main objective of the present invention is to provide an improved ratchet wrench.

To achieve the objective, an insulating ratchet wrench comprises a wrench body, a ratchet assembly, a main insulator and a knob, the wrench body having a handle defined at one end thereof and a head defined at another end thereof, the ratchet assembly assembled in the head, the ratchet assembly having a driving part and a driving member protruded from two sides of the head respectively, the wrench body covered with the main insulator, the main insulator having a first insulating ring formed at one end thereof, the driving member passing through the first insulating ring, the main insulator having a second insulating ring formed at another end thereof; the driving part passing through the second insulating ring, a distance being defined between the second insulating ring and the driving part, the first insulating ring having a main annular wall and a sub annular wall annularly defined on a bottom surface thereof, the knob assembled with the driving member and the first insulating ring enclosed by the knob, the knob having a main annular groove defined therein, the main annular groove corresponding to the main annular wall, the knob having a sub annular groove defined therein, the sub annular groove corresponding to the sub annular wall, the main annular groove and the sub annular groove of the knob slidaly sleeving onto the main annular wall and the sub annular wall respectively. Wherein one gap is defined between one end of the main annular wall and the bottom of the main annular groove; another gap is defined between one end of the sub annular wall and the bottom of the sub annular groove; the main annular wall and the sub annular wall are concentrically and spacingly extended from a bottom surface of the first insulating ring; the height of the main annular wall equals to the height of the sub annular wall; an outer periphery of the knob is enclosed by an inner periphery of the first insulating ring; the main insulator has a first insulating layer and a second insulating layer; the first insulating layer and the second insulating layer are formed as a multi-layer structure, so that the wrench body is covered with the first insulating layer and the second insulating layer; the main insulator is a single insulating layer and the wrench body is covered with the single insulating layer.

Under this arrangement, the knob is assembled with the main insulator by the main annular groove and the sub annular groove sleeving onto the main annular wall and the sub annular wall respectively so as to form an overlapping structure between the ratchet assembly and the knob; therefore, when a user rotates the knob or holds the wrench body near the ratchet assembly, the main insulator prevents the user from being attacked by an electric shock in a saltatory conduction manner from a charged object via the ratchet assembly.

Further benefits and advantages of the present invention will become apparent after a careful reading of the detailed description with appropriate reference to the accompanying drawings.

DETAILED DESCRIPTION OF THE INVENTION

Figure 1:
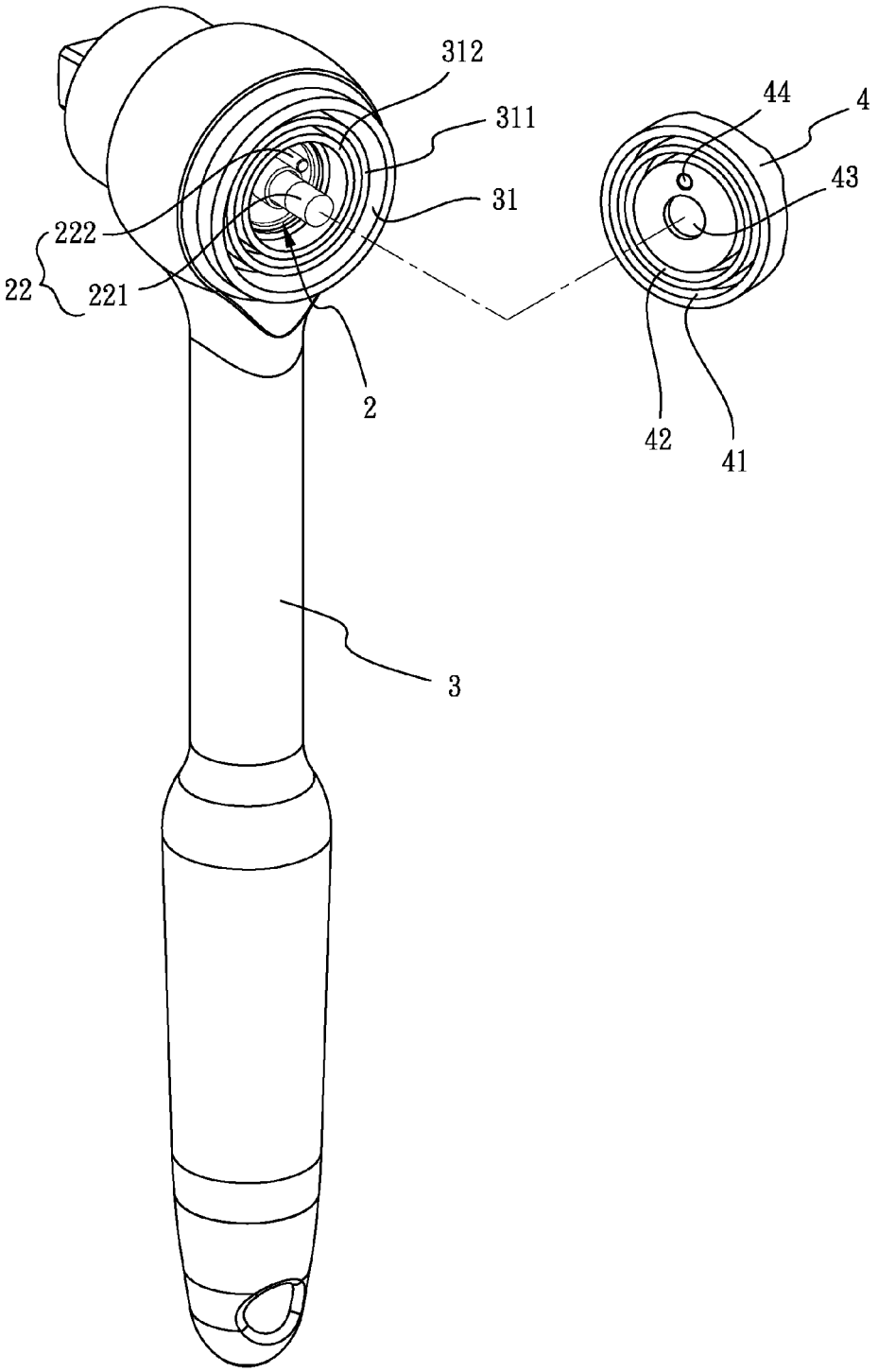
FIG. 1 is a partial exploded perspective view of an insulating ratchet wrench of the present invention.
Figure 2:
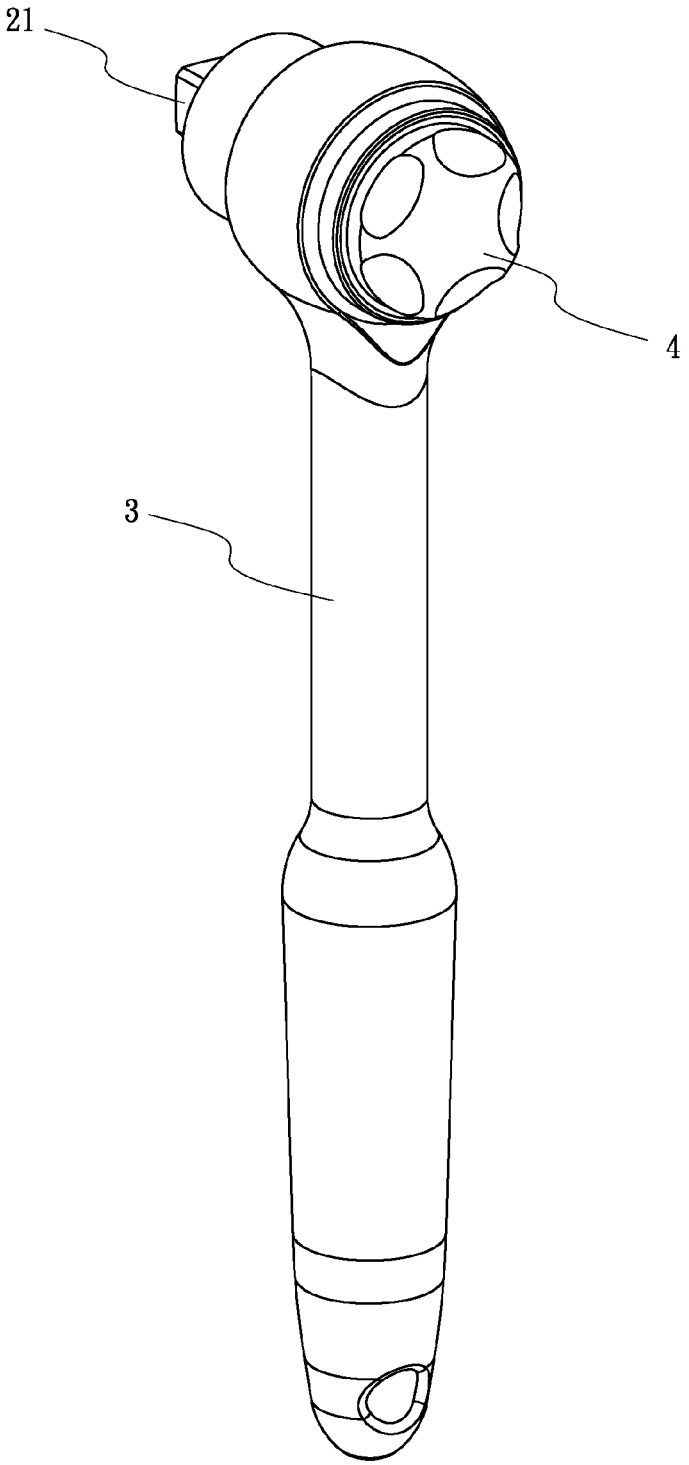
FIG. 2 is a perspective view of the insulating ratchet wrench of the present invention.
Figure 3:
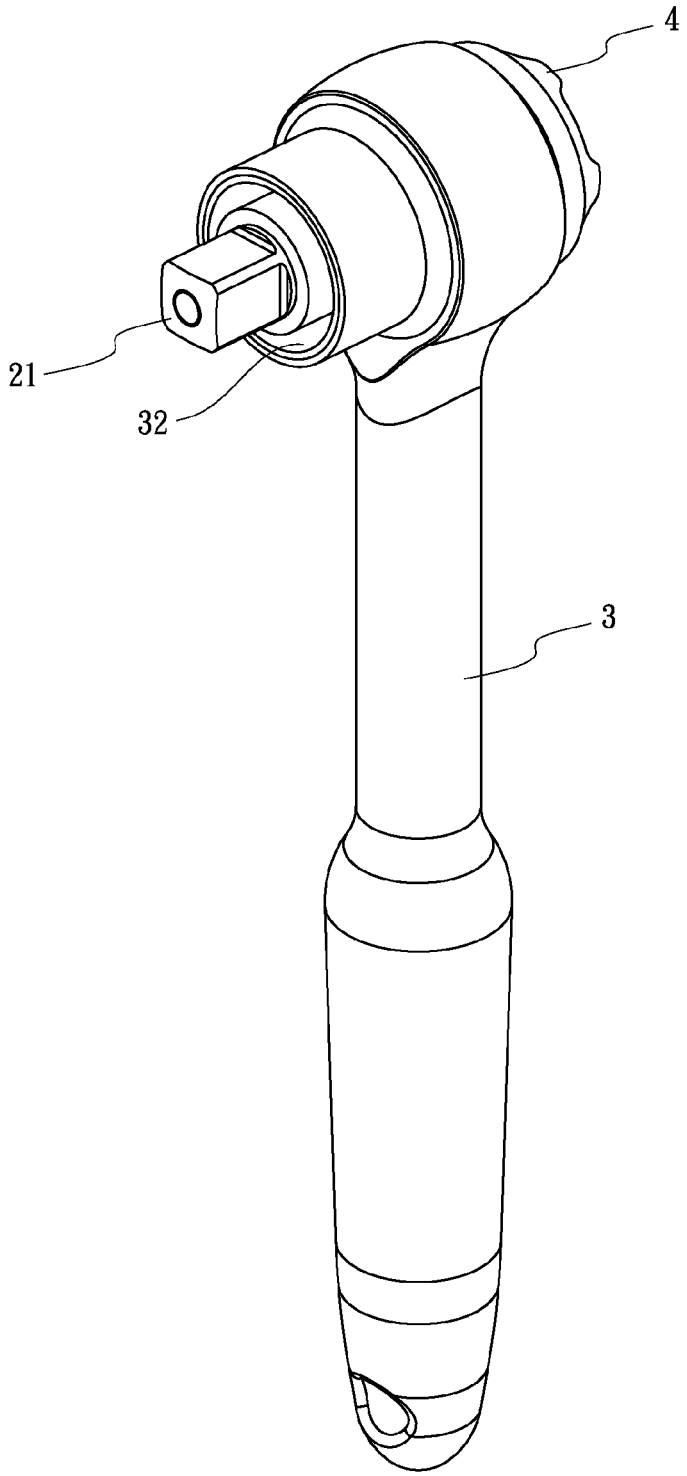
FIG. 3 is another perspective view of the insulating ratchet wrench of the present invention.

Referring to FIGS. 1-3, an insulating ratchet wrench in accordance with the present invention comprises a wrench body 1, a ratchet assembly 2, a main insulator 3 and a reverse knob 4.

The wrench body 1 has a handle 11 defined at one end thereof and a head 12 defined at another end thereof.

The ratchet assembly 2 is assembled in the head 12. The ratchet assembly 2 has a driving part 21 and a reverse driving member 22 protruded from two sides of the head 12 respectively. The driving part 21 is used for locking or unlocking an object (not shown). The reverse driving member 22 includes a central shaft 221 and an eccentric pin 222 in parallel with the central shaft 221, as shown in FIG. 1 or 5, and cooperates with the reverse knob 4 to control the rotating direction of the ratchet assembly 2, as will be discussed further later.

The wrench body 1 is covered with the main insulator 3. The main insulator 3 has a first insulating ring 31 formed at one end thereof. The reverse driving member 22 passes through the first insulating ring 31. The main insulator 3 has a second insulating ring 32 formed at another end thereof. The driving part 21 passes through the second insulating ring 32 and one end of the driving part 21 is exposed form the second insulating ring 32. A distance is defined between the second insulating ring 32 and the driving part 21. The first insulating ring 31 has a main annular wall 311 and a sub annular wall 312 concentrically and spacingly extended from a bottom surface thereof.

The reverse knob 4 is assembled with the reverse driving member 22 and the first insulating ring 31 is enclosed by the reverse knob 4. An outer periphery of the reverse knob 4 is enclosed by an inner periphery of the first insulating ring 31. The reverse knob 4 has a main annular groove 41 defined therein. The main annular groove 41 corresponds to the main annular wall 311. The reverse knob 4 has a sub annular groove 42 defined therein. The sub annular groove 42 corresponds to the sub annular wall 312. The height of the main annular wall 311 equals to the height of the sub annular wall 312. The main annular groove 41 and the sub annular groove 42 of the reverse knob 4 slidably sleeves onto the main annular wall 311 and the sub annular wall 312 respectively. One gap (not numbered) is defined between one end of the main annular wall 311 and the bottom of the main annular groove 41. Another gap (not numbered) is defined between one end of the sub annular wall 312 and the bottom of the sub annular groove 42.

Figure 4:
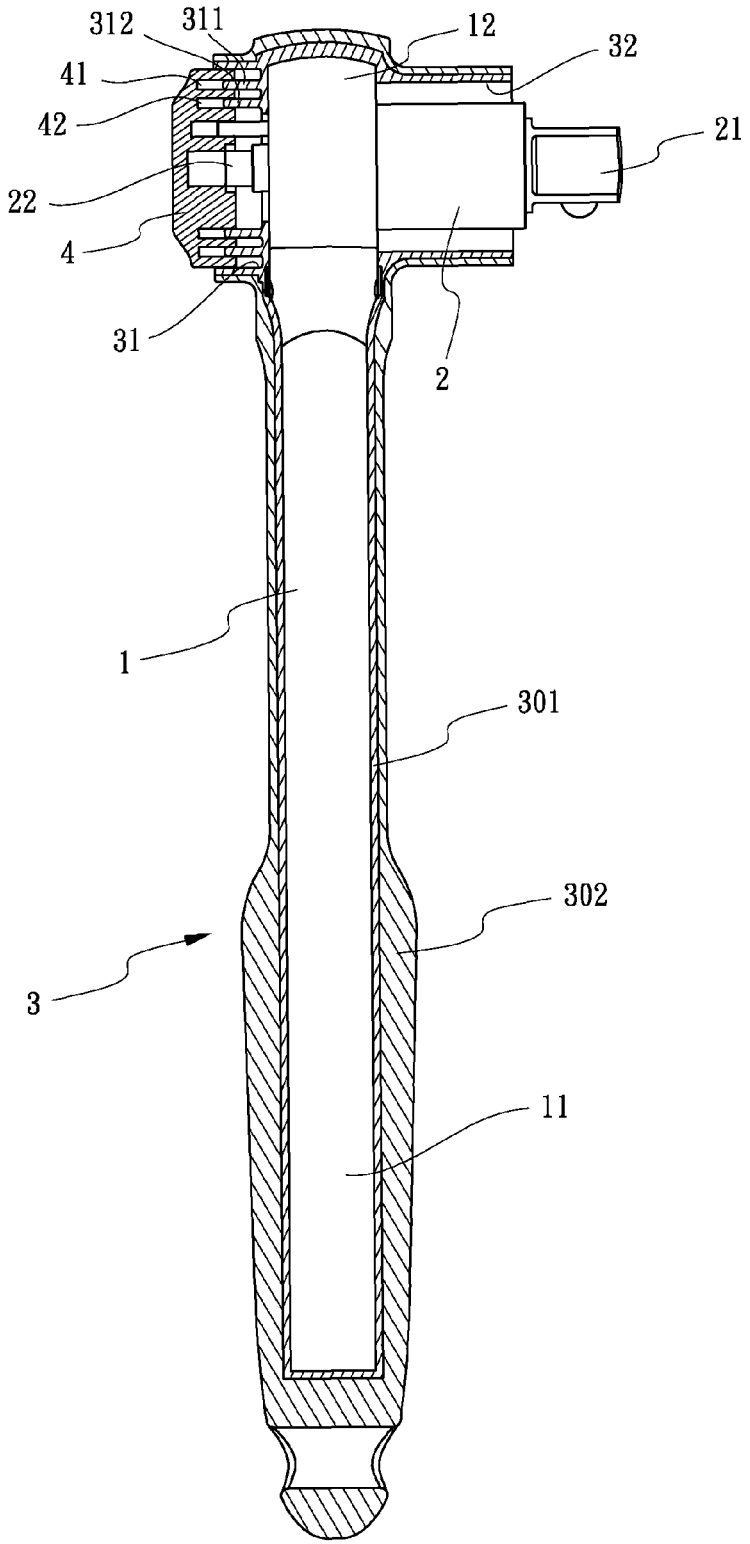
FIG. 4 is a cross-sectional view of the insulating ratchet wrench of the present invention.
Figure 5:
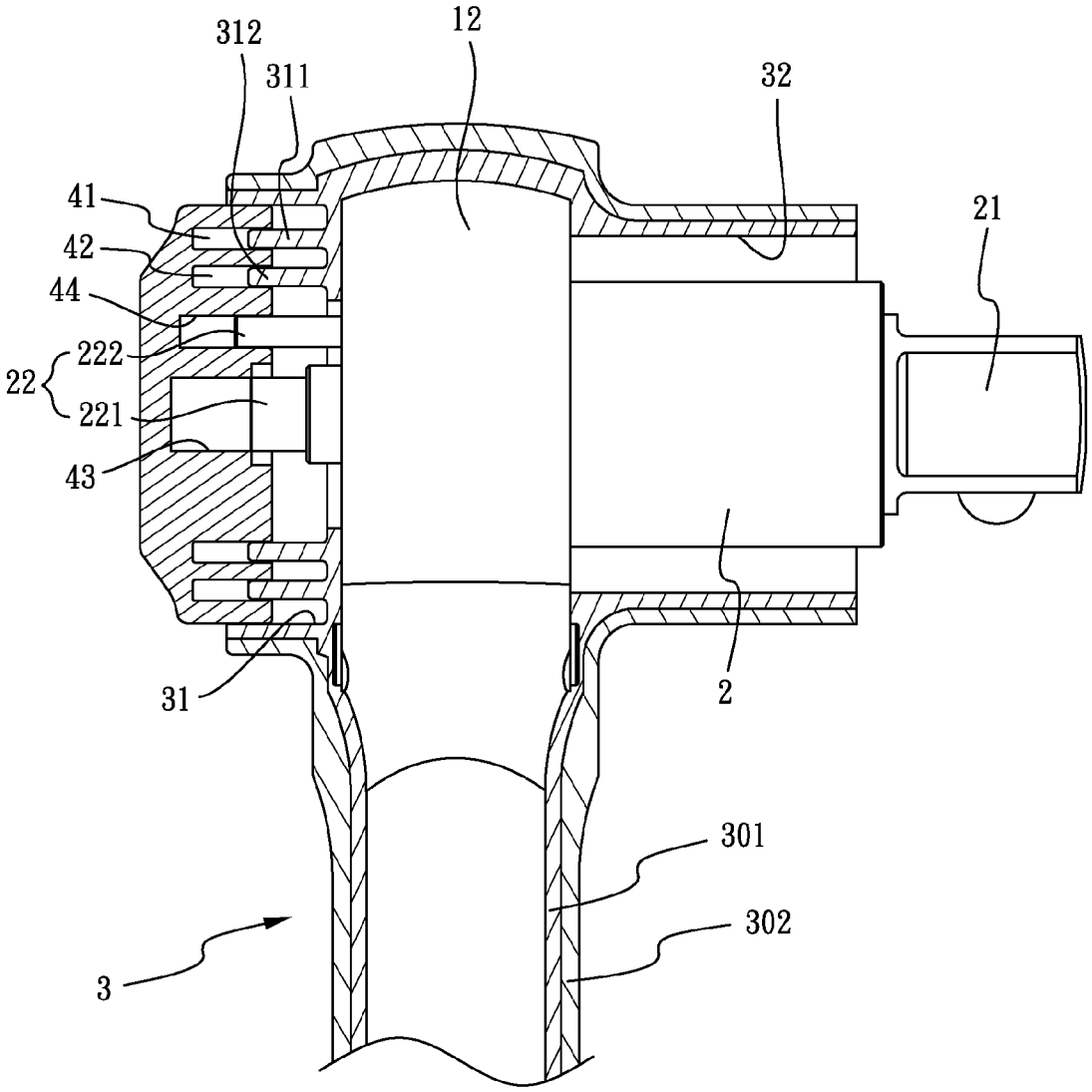
FIG. 5 is a partial enlarged view of FIG. 4.

Referring to FIGS. 4-5, the wrench body 1 is covered with the main insulator 3, wherein the main insulator 3 forms the second insulating ring 31 and the first insulating ring 32 corresponding to the driving part 21 and the reverse driving member 22 respectively. Therefore, the large scale of the wrench body 1 is covered with the main insulator 3, so that the ratchet assembly 2 is insulated against the electric conduction of a charged object.

Furthermore, the reverse knob 4 is assembled with the main insulator 3 by the main annular groove 41 and the sub annular groove 42 sleeving onto the main annular wall 311 and the sub annular wall 312 respectively so as to form an overlapping structure between the ratchet assembly 2 and the reverse knob 4. The reverse knob 4 further defines a central hole 43 for insertion of the central shaft 221 of the reverse driving member 22, and an eccentric hole 44 for insertion of the eccentric pin 222 of the reverse driving member 22, as best seen in FIG. 5. In this way, it is understood that rotation of the reverse knob 4 will drive the reverse driving member 22 to rotate, thereby controlling the rotating direction of the ratchet assembly 2. Therefore, when a user rotates the reverse knob 4 or holds the wrench body 1 near the ratchet assembly 2, the main insulator 3 prevents the user from being attacked by an electric shock in a saltatory conduction manner from the charged object via the ratchet assembly.

Figure 6:
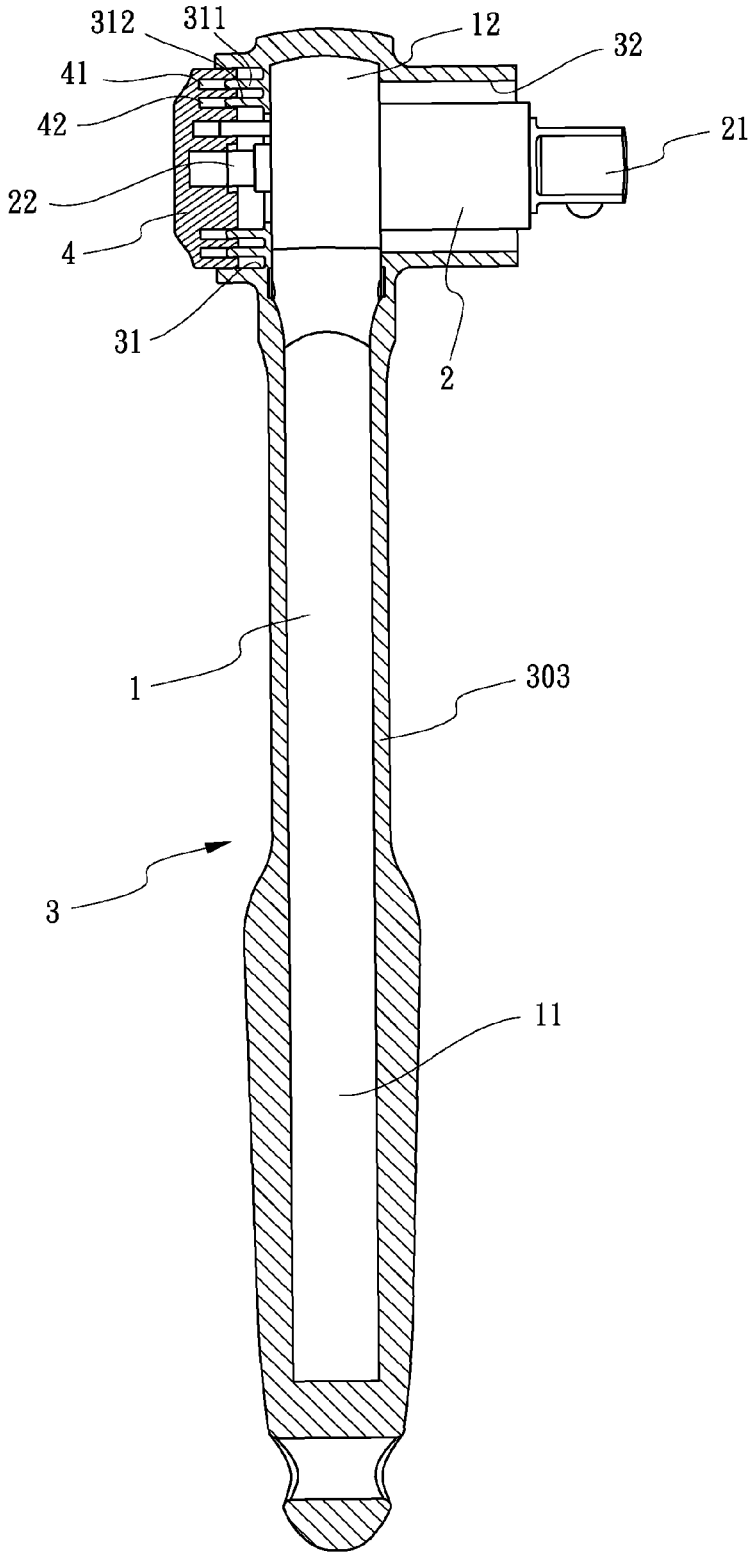
FIG. 6 is a cross-sectional view of the present invention for showing a main insulator with single insulating layer.

In addition, referring to FIGS. 4-5, the main insulator 3 has a first insulating layer 301 and a second insulating layer 302. The first insulating layer 301 and the second insulating layer 302 are formed as a multi-layer structure, so that the wrench body 1 is covered with the first insulating layer 301 and the second insulating layer 302. Referring to FIG. 6, the main insulator 3 is a single insulating layer 303 and the wrench body 1 is covered with the single insulating layer 303. (The number of the insulating layer is not limited in the present invention.)

Although the invention has been explained in relation to its preferred embodiment, it is to be understood that many other possible modifications and variations can be made without departing from the spirit and scope of the invention as hereinafter claimed.

What is claimed is:

1. An insulating ratchet wrench comprising:

a wrench body, a ratchet assembly, a main insulator and a reverse knob;

the wrench body having a handle defined at one end thereof and a head defined at another end thereof;

the ratchet assembly assembled in the head, the ratchet assembly having a driving part and a reverse driving member protruded from two sides of the head respectively; wherein the reverse driving member includes a central shaft and an eccentric pin in parallel with the central shaft, and the reverse driving member cooperates with the reverse knob in controlling a rotating direction of the ratchet assembly;

the wrench body covered with the main insulator, the main insulator having a first insulating ring formed at one end thereof, the reverse driving member passing through the first insulating ring, the main insulator having a second insulating ring formed at another end thereof; the driving part passing through the second insulating ring, a distance being defined between the second insulating ring and the driving part, the first insulating ring having a main annular wall and a sub annular wall annularly defined on a bottom surface thereof; and the reverse knob assembled with the reverse driving member and the first insulating ring enclosed by the reverse knob, the reverse knob having a main annular groove defined therein, the main annular groove corresponding to the main annular wall, the reverse knob having a sub annular groove defined therein, the sub annular groove corresponding to the sub annular wall, the main annular groove and the sub annular groove of the reverse knob slidaly sleeving onto the main annular wall and the sub annular wall respectively;

wherein the reverse knob is assembled with the main insulator by the main annular groove and the sub annular groove sleeving onto the main annular wall and the sub annular wall respectively so as to form an overlapping structure between the ratchet assembly and the reverse knob; and wherein the reverse knob further defines a central hole for insertion of the central shaft of the reverse driving member, and an eccentric hole for insertion of the eccentric pin of the reverse driving member so that rotation of the reverse knob drives the reverse driving member to rotate, thereby controlling the rotating direction of the ratchet assembly.

2. The insulating ratchet wrench as claimed in claim 1, wherein one gap is defined between one end of the main annular wall and the bottom of the main annular groove; another gap is defined between one end of the sub annular wall and the bottom of the sub annular groove.

3. The insulating ratchet wrench as claimed in claim 1, wherein the main annular wall and the sub annular wall are concentrically and spacingly extended from a bottom surface of the first insulating ring.

4. The insulating ratchet wrench as claimed in claim 1, wherein the height of the main annular wall equals to the height of the sub annular wall.

5. The insulating ratchet wrench as claimed in claim 1, wherein an outer periphery of the reverse knob is enclosed by an inner periphery of the first insulating ring.

6. The insulating ratchet wrench as claimed in claim 1, wherein the main insulator has a first insulating layer and a second insulating layer; the first insulating layer and the second insulating layer are formed as a multi-layer structure, so that the wrench body is covered with the first insulating layer and the second insulating layer.

7. The insulating ratchet wrench as claimed in claim 1, wherein the main insulator is a single insulating layer and the wrench body is covered with the single insulating layer.

* * * * *